United States Patent [19]

Kornbrekke et al.

[11] Patent Number: 4,727,679

[45] Date of Patent: Mar. 1, 1988

[54] SWING-DOOR OPERATOR SYSTEM

[75] Inventors: Henning N. Kornbrekke, Burlington; Philip J. Lombardo, Simsbury; Leon Boiucaner, Farmington; Sam L. Crocker, Avon, all of Conn.

[73] Assignee: The Stanley Works, New Britain, Conn.

[21] Appl. No.: 33,183

[22] Filed: Apr. 2, 1987

[51] Int. Cl.[4] ..... E05F 15/00

[52] U.S. Cl. ..... 49/138; 49/340; 49/345

[58] Field of Search ..... 49/138, 340, 345

[56] References Cited

U.S. PATENT DOCUMENTS

| | | | |
|---|---|---|---|
| 2,820,241 | 1/1958 | Schlage | 49/138 X |
| 3,114,541 | 12/1963 | Coffey | 49/138 |
| 3,874,117 | 4/1975 | Boehm | 49/340 X |
| 4,658,545 | 4/1987 | Ingham et al. | 49/340 |

FOREIGN PATENT DOCUMENTS

| | | | |
|---|---|---|---|
| 842533 | 5/1970 | Canada | 49/138 |
| 2405281 | 8/1975 | Fed. Rep. of Germany | 49/138 |

OTHER PUBLICATIONS

Roto Swing, Inc. brochure, U.S.A. Models 1, and 2, date not known but at least as early as Dec., 1986.

*Primary Examiner*—Philip C. Kannan

*Attorney, Agent, or Firm*—Chilton, Alix & Van Kirk

[57] ABSTRACT

An operator for swing-door employs an electronic control unit for controlling the operation of a motor. The motor is bi-directionally driven at various speeds for opening, closing, braking and maintaining a given position of an associated swing-door. The motor drive shaft is mechanically connected via a timing belt/pulley system with an operator shaft for transmitting torque to a linkage assembly. The linkage assembly is configured to provide a high mechanical advantage at the fully opened and fully closed positions of the associated swing-door.

28 Claims, 12 Drawing Figures

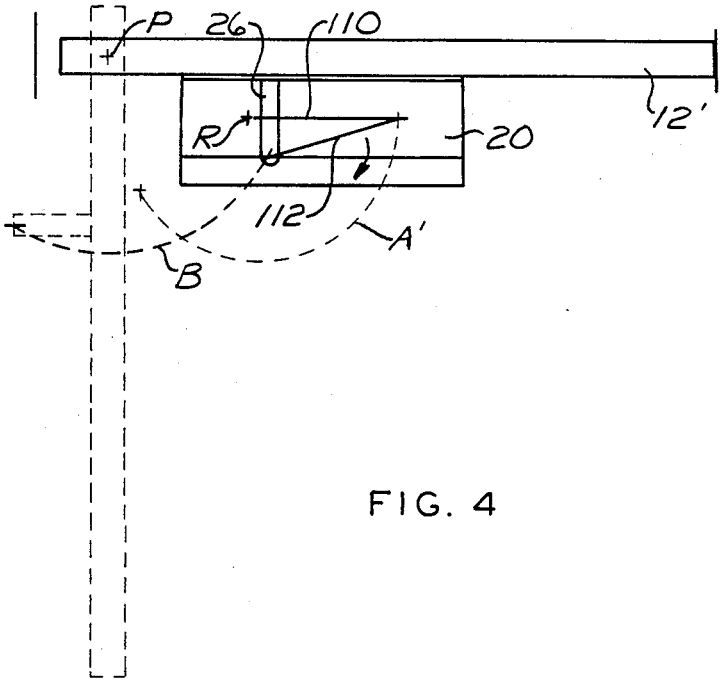
FIG. 4
FIG. 5
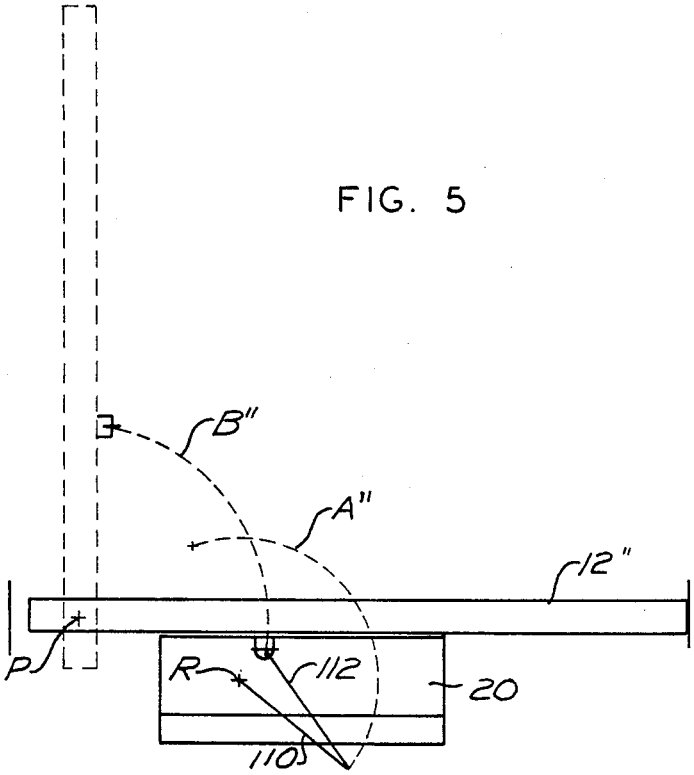

SWING-DOOR OPERATOR SYSTEM

BACKGROUND OF THE INVENTION

This invention relates generally to operators which automatically control the opening and closing of swing-doors. More particularly, the present invention relates to operators which may be mounted in close proximity to the door frame and mechanically connected to a swing-door for electrical actuation to thereby control the operation of the door.

Numerous operator systems have been advanced for automatically controlling the opening and the closing of swing-doors. While many of such conventional door operators have proved satisfactory for a wide range of applications, in general, the principal limitations of conventional swing-door operators are relatively high manufacturing costs, energy inefficiency, lack of reliability over extended periods of usage and relatively demanding maintenance requirements. Accordingly, it is a principal aim of the present invention to provide a new and improved swing-door operator system which overcomes the noted disadvantages of conventional swing-door operator systems.

SUMMARY OF THE INVENTION

Briefly stated, the invention in a preferred form is a door operator system for controlling the operation of a pivotally moveable door. The system comprises a motor which is selectively bi-directionally driven. An electronic controller is responsive to various input signals and selects a voltage value from an array of pre-established voltages to derive a motor voltage and generate a desired voltage polarity signal. The polarity signal and the selected motor voltage value are applied to the motor for driving the motor drive shaft at a selected speed and in a given direction. A mechanical transmission translates rotatable motion of the motor drive shaft to a corresponding reduced rotatable motion of an operator shaft. A mechanical linkage connects the operator shaft in generally fixed angular relationship. The linkage comprises a connector which pivotally connects at a fixed location of an associated door. The operator shaft angularly drives the linkage for pivotably opening and closing the associated door in accordance with the operation of the motor.

The motor and the transmission are mounted in a housing with a portion of the operator shaft projecting through the housing. In one form of the invention, the transmission comprises pulley belt units for translating the rotational motion of the motor drive shaft to the idler shaft. The pulleys are molded form a plastic material and the belt widths are dimensioned proportionate to the amount of transmitted torque. The ratio of the speed of the motor drive shaft in relation to the speed of the operator shaft is preferably in the range of 30 to 100. When the associated door is pivoted approximately 90°, the operator shaft is rotated an angular distance in the range of 120° to 180°. Stops are provided for preventing the operator shaft from angularly rotating beyond a pre-established angular position. A timing cam is mounted in angularly fixed relationship with the operator shaft. A switch is responsive to the angular position of the timing cam for transmitting an input signal to the electronic controller. The input signal is indicative of a pre-established angular position of the operator shaft. The timing cam comprises an adjustable plate which is adjustable to define two angular positions. The switch is responsive to pre-selected angular positions of the timing cam for transmitting signals indicative of attained opening and closing door positions.

The linkage includes a crank arm which is connected at one end in fixed angular relationship with the operator shaft. The other end of the crank arm is pivotally connected to a link. A bracket adapted for mounting in fixed relationship to an associated door so as to project outwardly therefrom has a pivot connector spaced from the door. The link is pivotally connected to the connector. The associated door is pivoted approximately 90° between the fully opened and closed positions. The linkage is configured so that at the fully closed and opened positions, the mechanical advantage of the linkage is at least greater than two. A sensor unit may be employed for sensing the presence of the door opening or door closing initiating event and transmitting an appropriate electrical input signal to the electronic controller for selective operation thereof.

The swing-door operator further employs a feed back signal device which is responsive to a pre-established angular position of the operator shaft for generating a CK signal. A door OPERATE input signal device generates a door status OPN signal. The electronic motor controller is responsive to the CK and OPN signals for selecting a reference voltage so that the drive shaft of the motor is sequentially operated in dual speed forward and reverse directions for rotating, braking and maintaining the operator shaft in a pre-determined position.

One pre-established voltage corresponds to a selected opening speed of the operator shaft and hence the associated swing-door. A second voltage corresponds to a selected closing speed of the operator shaft. A third voltage corresponds to a reduced check speed of the operator shaft. A fourth pre-established voltage corresponds to the magnitude of a stall torque of the operator shaft. The electronic controller includes circuitry for sensing the current applied to the motor and correspondingly adjusting the voltage applied to the motor. Braking circuitry is also employed for applying a braking torque to the motor drive shaft by reversing the voltage polarity to the motor leads for a pre-established time interval when the CK signal changes from a low to a high state. A reduced reference voltage is applied to the motor subsequent to the elapse of the braking time interval. An electromechanical relay is employed for reversing the electrical leads to the motor to thereby change the voltage polarity.

An object of the invention is to provide a new and improved swing-door operator which is relatively inexpensive to manufacture and has an efficient construction and operation.

Another object of the invention is to provide a new and improved swing-door operator system which operates in a highly energy efficient manner.

A further object of the invention is to provide a new and improved swing-door operator system which may be relatively easily installed for operation in connection with an associated swing-door system and is capable of reliable and relatively maintenance free operation over an extended period.

A yet further object of the invention is to provide a new and improved swing-door operator system wherein an electric motor is electronically controlled to provide a positive operative control over an associated swing-door system throughout the swing-door operation including opening, closing, braking and maintaining the swing-door at a given position.

Other objects and advantages of the invention will become apparent from the specification and the drawings.

BRIEF DESCRIPTION OF THE DRAWINGS

FIG. 4 is a top schematic view of a swing-door and an operator system in accordance with the present invention illustrating the operation of the system for an "in" swing-door;

FIG. 5 is a top schematic view of a swing-door and an operator system in accordance with the present invention illustrating the operation of the system for "out" door;

DETAILED DESCRIPTION OF THE INVENTION

With reference to the drawings wherein like numerals represent like parts throughout the figures, a swing-door operator system in accordance with the present invention is generally designated by the numeral 10. Operator system 10 is adapted to open and close a swing-door 12 and to generally positively control the position of the swing-door at each position thereof. The operator system functions to pivot the swing-door from the closed to the opened position and to positively return the swing-door to the closed position. For purposes of illustrating the invention, swing-door 12 is of a conventional type which pivots approximately 90° from the fully closed to the fully opened position as schematically illustrated in FIGS. 4 and 5. Actuation of the operator system to initiate an opening sequence may be accomplished by conventional actuation means (not illustrated) such as floor mats, radio-control, key switches, motion detectors, etc.. The operator system 10 is preferably powered by a 120 volt power source.

Figure 1:
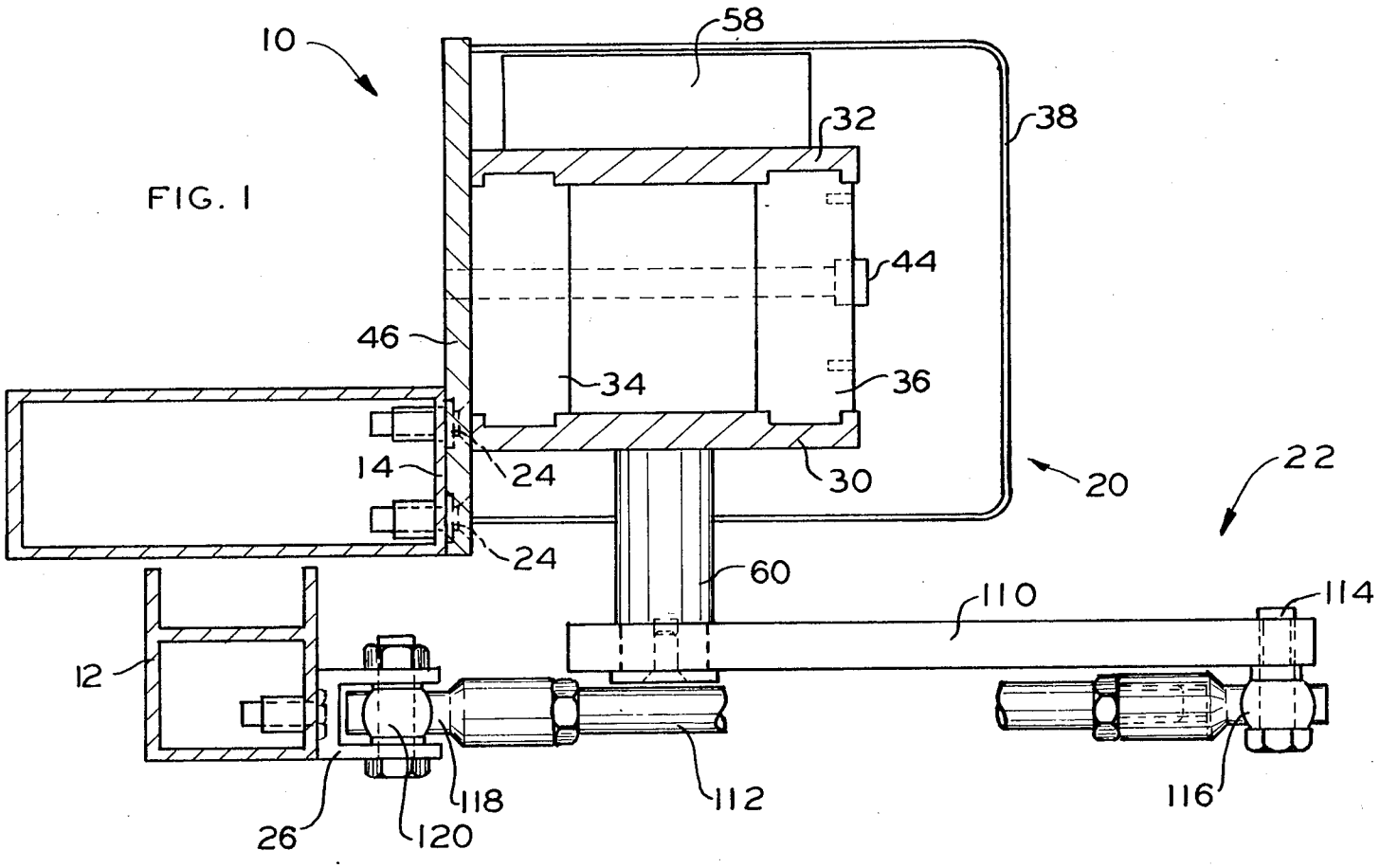
FIG. 1 is an end sectional view, partly broken away, of a swing-door operator system in accordance with the present invention, the swing-door system being illustrated in an installed position in relation to a swing-door which is partially illustrated.

With reference to FIG. 1, swing-door operator system 10 comprises a housing module 20 and a mechanical linkage assembly 22 which connects to the swing-door 12. The housing module 20 is preferably mounted at the surface of a door header 14 above the swing-door 12. Bolts 24 or other fasteners may be employed to secure the housing module to the header or door frame. The linkage assembly 22 operatively connects between the housing module 20 and the swing-door 12 via a bracket 26. Bracket 26 is bolted to the swing-door at a fixed location at the top of the door. Input command signals and electrical power are received at the housing module. The module 20 houses an electric motor and mechanical transmission which correspondingly operates via the linkage assembly to control the pivotal position of the swing-door. A mounting bracket (not illustrated) may be employed for mounting the housing module to the header 14 or other fixed location generally above the swing-door. It should be appreciated that the housing module is relatively compact. In a preferred application, the housing module has a substantially rectangular form with the width, height and depth of the module of one operator system embodiment being approximately $15\frac{1}{4}$, 5 and 5+ inches, respectively. The swing-door operator system may be universally employed for use in connection with both "in" (FIG. 4) and "out" (FIGS. 1 and 5) swing-door applications.

Figure 2:
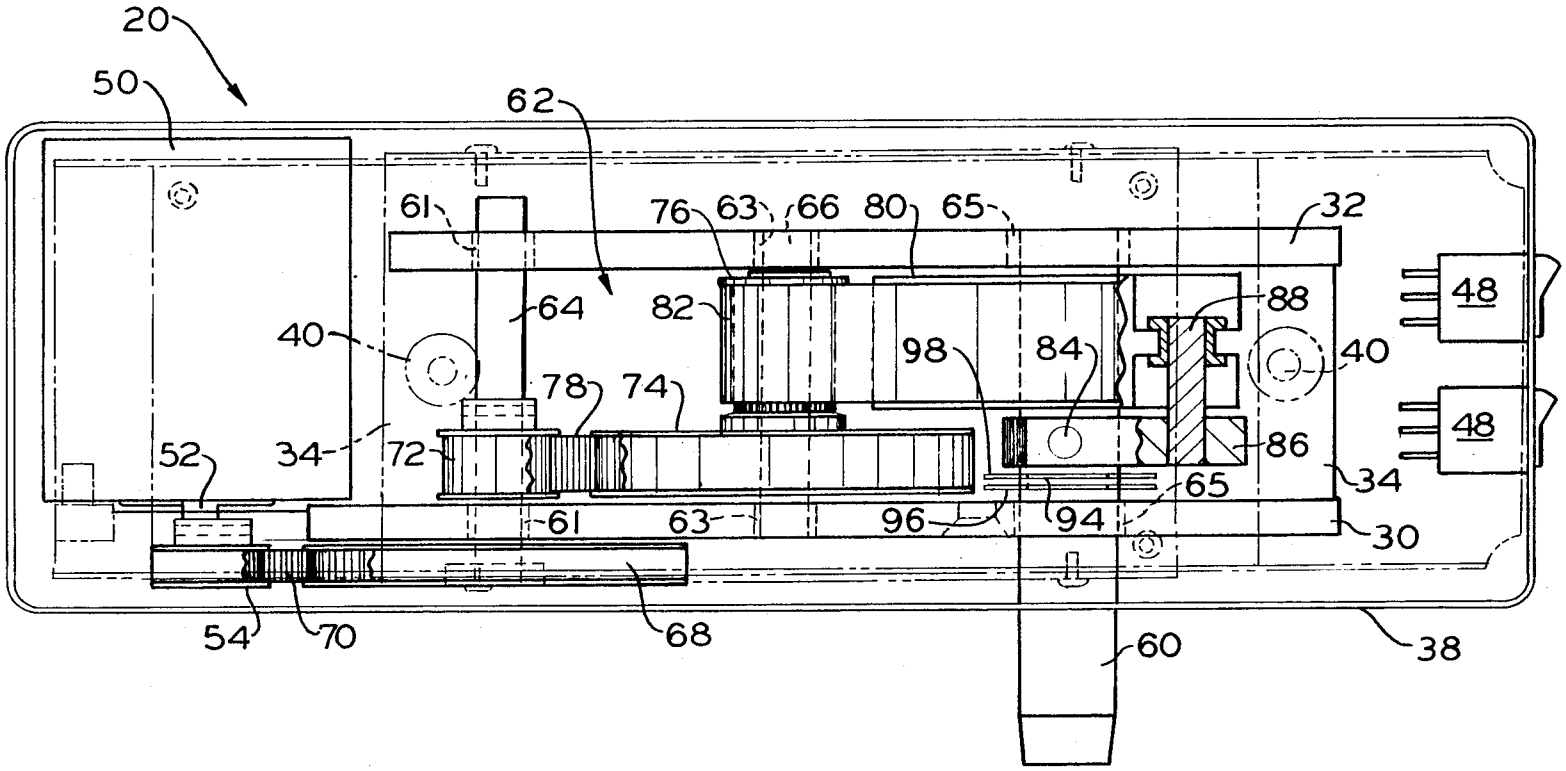
FIG. 2 is a front interior view, partly broken away, partly in section and partly in phantom, of the operator module of the operator system of FIG. 1.
Figure 3:
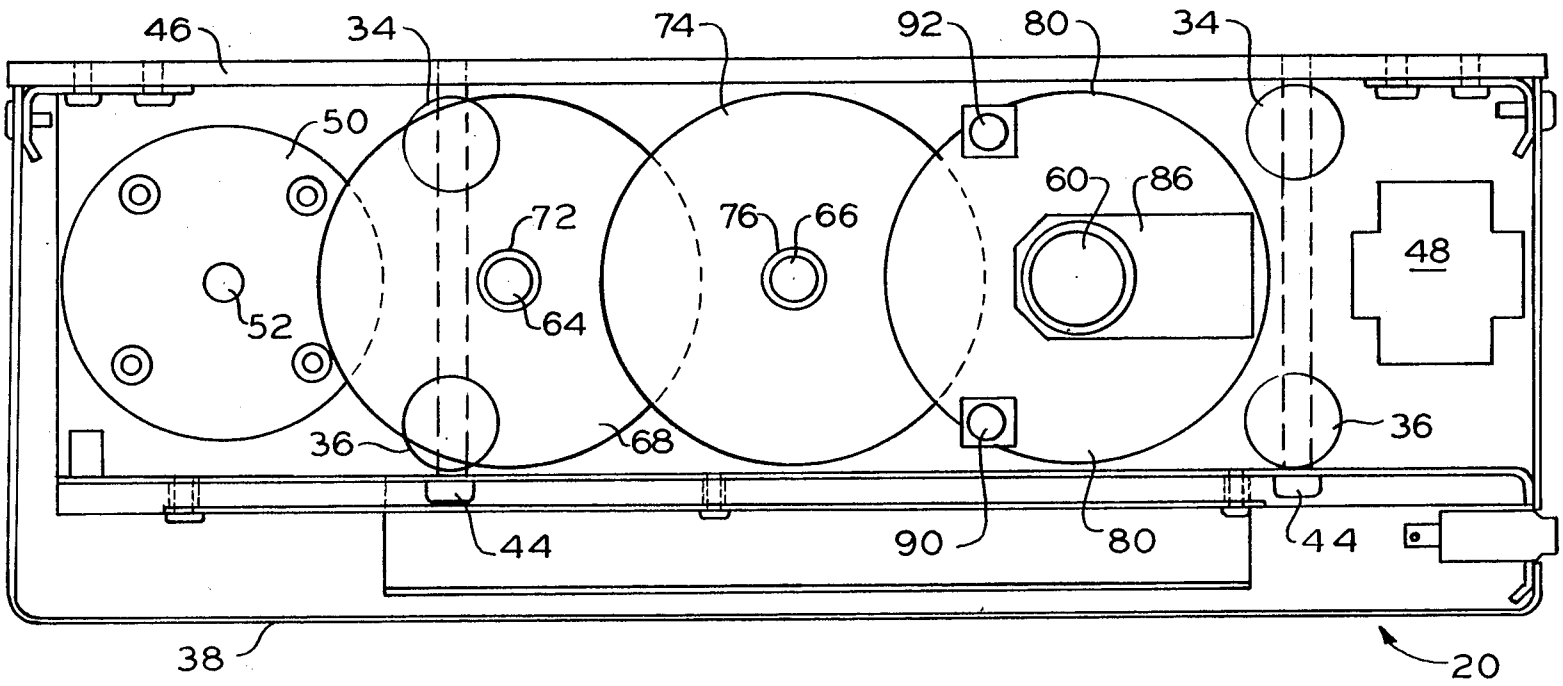
FIG. 3 is a top interior view, partly in phantom and partly in section, of the operator module of FIG. 2, portions of the module being removed.

With additional reference to FIGS. 2 and 3, a pair of vertically spaced plates 30 and 32 are mounted interiorly of the housing module to provide the principal support structure for the mechanical components of the operator. Two pairs of cross-supports 34 and 36 extend between plates 30 and 32 at horizontally spaced locations to fix the plates in vertically spaced relationship. Bolts fasten the plates to the cross-supports. Bores 40 extend through the cross-supports 34 and 36, respectively, for receiving fasteners 44 to secure the plate-support frame to a housing mounting plate 46. A housing cover 38 of generally rectangular form is also fastened to the housing mounting plate 46.

Manually operable rocker switches 48 are accessed through the housing cover 38 for manually placing the system in an on/off mode and/or in a normal, fully opened, or fully closed operational mode.

An electric motor 50 is mounted at an extension end of plate 30 interiorly of the housing. The drive shaft 52 of the electric motor 50 extends through an opening in plate 30. A driver wheel or pulley 54 is mounted at the end of the drive shaft in fixed angular relationship therewith. Motor 50 is a permanent magnet, brush type DC motor of conventional fractional horsepower form. An exemplary motor suitable for use is a 115 volt DC permanent magnet motor having a static resistance of 28.5 ohms, a voltage coefficient per 1000 rpm of 56.5, and a torque coefficient of 76.4 oz.-in. per amp. The foregoing electric motor 50 at stall generates a torque of approximately 300 oz.-in. and at normal speed generates a torque of approximately 120 oz.-in. As detailed below, the motor 50 intermittently operates at a high load, low speed level which generates a relatively high torque.

An electronic control unit designated generally by the numeral 58 is housed within the housing module in front of plate 32. The electronic control unit 58 (functionally illustrated in FIG. 6) controls the operation of the electric motor. The control unit is responsive to an "operate" input signal and a "safety" input signal and functions to generate appropriate signals to the motor for opening, closing or maintaining the position of the associated swing-door. The electronic control unit 58 generates signals which cause the motor to operate at either a full speed or a check speed in both the opening and closing directions as well as to brake the pivotal movement of the associated swing-door by application of a reverse torque to the motor drive shaft. The control unit also generates signals for energizing the motor in a stalled mode wherein the position of the door is maintained at a pre-established force threshold in the opened, closed and intermediate pivotal positions. The motor control unit provides means wherein adjustments may be implemented for selectively pre-setting the door opening speed, the door closing speed, door check speeds, a brake time interval, a hold open/closed force threshold and a hold open time delay interval. The control unit 58 also incorporates a motor operation feed back circuit which models the operation of the electric motor to sense the motor voltage and current and to thereby compensate for motor load, line voltage variations and line rectifier output ripple effects. The operation and functions of the electronic control unit are described in detail below.

An operator shaft or spindle 60 is mounted in openings of plates 30 and 32 in parallel relationship to drive shaft 52. The spindle 60 extends exteriorly through the housing cover 38 for rotatably driving the linkage assembly to thereby control the position of the swing-door. A transmission assembly designated generally by the numeral 62 translates rotary motion of the drive shaft 52 to rotary motion of the operator spindle 60 by reducing the motor speed and thereby increasing the torque output of the spindle. The transmission assembly 62 has a relatively low mechanical gear ratio.

A first idler shaft 64 and a second idler shaft 66 extend between the plates 30 and 32 in parallel relationship with the motor drive shaft 52 and the operator spindle 60. Spindle 60 and shafts 64 and 66 are formed from steel. Pairs of molded bearings 61, 63 and 65 are mounted in opposed openings of the plates 30 and 32 for rotatably mounting the respective spindle 60, shaft 64 and shaft 66 and locating the respective members in fixed spaced relationship for rotatable motion. The bearings are preferably molded from plastic material and are accurately dimensioned to precisely locate the idler shafts and the spindle. The bearings additionally function to provide a relatively inexpensive transmission assembly which does not require lubrication.

A driven timing pulley 68 is mounted at the lower end of idler shaft 64. Timing pulley 68 is a molded member having 60 teeth. Driver pulley 54 is a molded member having 16 teeth. A timing belt 70 having cogs which key with teeth in pulleys 54 and 68 rotatably connects pulleys 54 and 68 to thereby transfer rotary drive of drive shaft 52 to rotate shaft 64. A driver pulley 72 is mounted in fixed angular relationship with idler shaft 64 between plates 30 and 32. Driver pulley 72 is a molded member having 18 teeth. The effective width of the driver pulley 72 is greater than the effective width of the coaxial driven pulley 68 on shaft 64 to accommodate the increased torque exerted by the driver pulley 72.

A driven timing pulley 74 integrally axially connects with a coaxial driver pulley 76, both of which are mounted in fixed angular relationship to idler shaft 66. Pulleys 74 and 76 are positioned between plates 30 and 32. Pulley 74 axially aligns with pulley 72 and is rotatably coupled therewith by means of a second timing belt 78. Pulleys 74 and 76 are also molded from plastic with pulley 74 having 60 teeth and pulley 76 having 18 teeth. The effective belt transmission width of pulley 76 is approximately twice the corresponding width for pulley 74.

A driven timing pulley 80 of molded plastic form axially aligns with pulley 76 and is mounted in fixed rotation with the operator spindle 60. Pulley 80 has 60 teeth and is rotatably coupled with pulley 76 by means of a third timing belt 82. Because of the relatively high torques which are applied to operator spindle 60, pulley 80 is keyed to spindle 60 by means of a steel pin 84. Pin 84 connects with a radially extending arm 86 which angularly rotates with operator spindle 60 and connects via an axial pin 88 with a recess formed in timing pulley 80 to thereby lock the timing pulley 80 in fixed rotational relationship with the operator spindle.

It will be appreciated that the foregoing timing belt-/pulley system results in a speed reduction of the operator spindle in relation to the drive shaft of the electric motor. For the described embodiment, the speed reduction ratio is approximately 52.73 to 1. The speed reduction results in a corresponding increase in the torque which is supplied and exerted by the operator spindle 60. Because of the proportionate torque increases, the timing belts 70, 78 and 82 are respectively of a progressively greater effective transmission width to accommodate the increased torque. It will be further appreciated that because there is essentially no belt tightening system or adjustment mechanism within the described transmission assembly, precise location of the idler shafts and the operator spindle in relation to the motor drive shaft is critical for optimum operation. In addition, the dimensioning and keying of the timing belts to the respective driver/driven pulley pairs requires precision since the operator system and the transmission unit is bi-directional with a single electric motor driving the associated door to the opened and to the closed positions as well as continuously maintaining the door in a given position.

Figure 11:
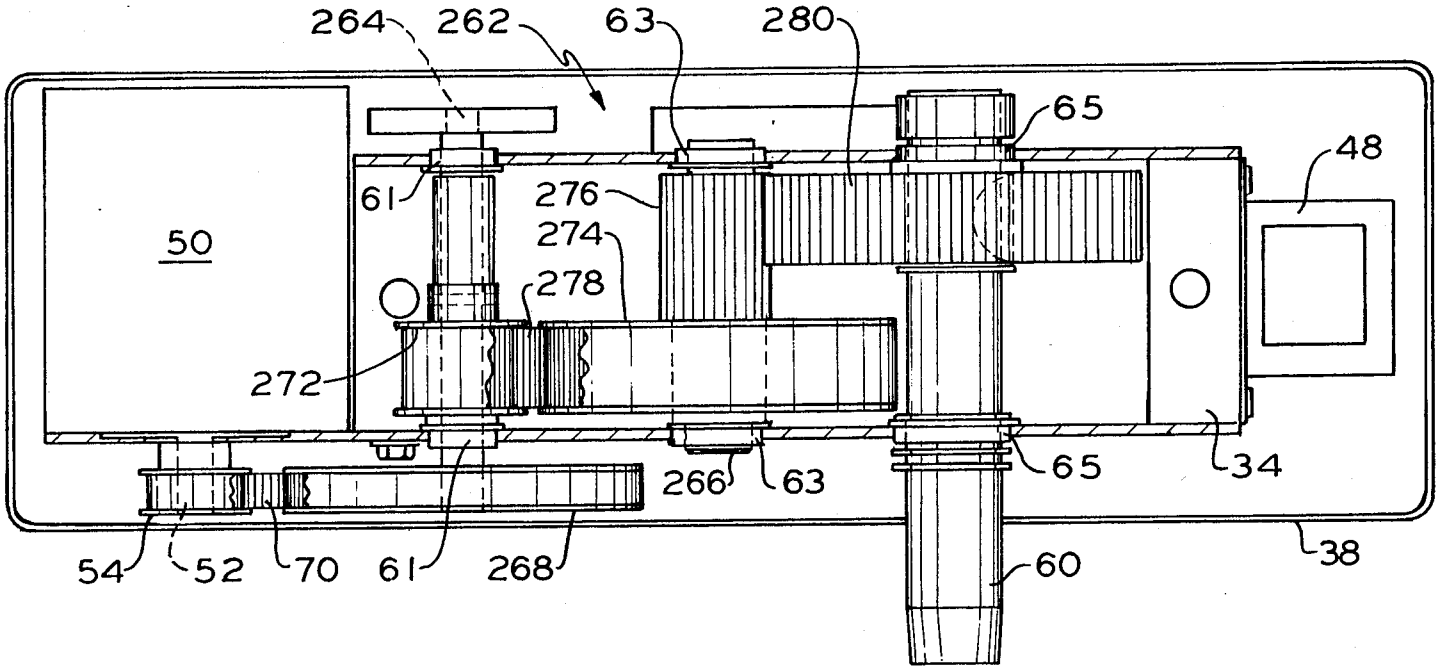
FIG. 11 is a front interior view, partly broken away and partly in section, of an alternate embodiment of an operator module for the operator system of FIG. 1.

An alternate embodiment of a transmission assembly for the swing-door operator system is designated generally by the numeral 262 in FIG. 11. Transmission assembly 262 is substantially identical in form and function to that described for transmission assembly 62, except that a gear assembly is employed in the last transmission unit rather than a timing belt/pulley unit as previously described. Idler shaft 264 mounts a driven timing pulley 268 and a driver pulley 272 which connects via a timing belt 270 with a driven pulley 274. Pulleys 272 and 274 have 18 and 60 teeth, respectively. Idler shaft 266 mounts pulley 274 and a steel pinion 276. The operator spindle 60 mounts a plastic gear 280 which meshes with pinion 276. Pinion 276 and gear 280 have 18 and 60 teeth, respectively. Plastic gear 280 is keyed to the steel operator spindle. The transmission assembly 262 for the described embodiment has mechanical ratio of 41.58. For some applications, the described pinion/gear assembly exhibits certain advantages in terms of rotational slippage as compared to a corresponding timing belt-/pulley assembly when relatively high torques are transmitted.

As will be described in greater detail below, the operator spindle angularly rotates approximately 150° to produce a corresponding normal pivoting of 90° of the door from the closed to the opened positions (as best illustrated in FIGS. 4 and 5). A pair of axially extending stops 90 and 92 extend between plates 30 and 32 and are offset from the operator spindle 60. The stops are engageable with arm 86 for limiting the angular position of the operator spindle. The stops are angularly located and the arm is angularly fixed in relation to the spindle so that the engagement defines an angular position which is substantially equivalent to the fully opened position of the door. Two stops are employed so that the unit may be used in either a right-hand or left-hand embodiment. Naturally, only one stop is effectively employed for a given application.

A timing cam unit 94 having a pair of angularly adjustable opening and closing timing cam plates 96 and 98 is also mounted in fixed angular relationship with the spindle 60. Plates 96 and 98 form recessed edges 95 and 97, respectively. The plates are angularly adjustable to define two angular positions. A timing micro switch 100 includes a biased follower 102 which at pre-established angular positions of the spindle follows edges 95 and 97 for transmitting a CK speed signal to the motor control to thereby commence braking of the door in either the opening or closing direction and subsequently transform the door operation to a reduced check speed.

With reference to FIGS. 1, 4 and 5, the linkage assembly 22 comprises a crank arm 110 and a bi-pivotal link 112. Crank arm 110 at one end connects in angularly fixed relationship with the spindle 60 so as to angularly rotate in radially extending fashion as the spindle rotates. The opposite end of crank arm 110 receives a pin 114 of a socket connector 116 threaded to link 112 to form a pivotal connection about the axis of pin 114. The opposite end of the connecting link threadably mounts a second socket connector 118 which pivotally connects with the bracket 26. The pin 120 is secured to the bracket by conventional means with link 112 being pivotal about a generally vertical axis through pin 120.

It should be appreciated that crank arm 110 and link 112 are disposed in substantially vertically spaced horizontal orientations. The crank arm 110 and the link 112 are angularly movable in generally horizontal planes. The crank arm 110 and the link 112 may have fixed lengths or conventional means for adjusting their lengths to accommodate the dimensional constraints for a given installation. Numerous alternative forms of linkage which provide a bi-pivotal link connection between the associated door and a crank arm angularly fixed to the operator spindle may be employed. The door module 20 including the spindle 60 is disposed generally vertically above the swing-door 12 with the connecting link 112 pivotally connecting the top portion of the door via the bracket 26.

The path of a swing-door as it is operated by swing-door operator system 10 for an "in" door opening application, is illustrated in FIG. 4. The loci of the angular positions of the pivotal connection between the crank arm and the link are illustrated by dashed line A'. The loci of the angular positions between the angular pivotal connection of the bracket and the link are illustrated by dashed line B'. The fully opened position of the "in" swing-door 12' is illustrated in phantom. It will be appreciated that as the motor drives the spindle in the clockwise direction of the arrow, the crank arm also drives the linkage and hence the door 12', through the bracket so that the door is angularly pivoted as illustrated in FIG. 4. The housing module 20 of FIG. 4 is essentially mounted against the face of the door frame which is substantially coplanar with the face of the door 12' in the fully closed position.

With additional reference to FIGS. 4 and 5, the distance between the rotational axis R of spindle 60 and the pivot axis P of the swinging door 12, the distance between the rotational axis of the spindle and the pivotal connection of the crank arm and the link, the distance between the pivotal connection of the link and the door bracket and the crank arm/link connection, and the distance between the pivot axis of the door and the bracket/link connection are preferably pre-selected so as to establish a relatively high mechanical advantage when the door is initially moved from the fully closed to the opened positions as well as when the door is initially driven from the fully opened to the closed positions. The foregoing relationship is advantageous since the higher torque demands which are ordinarily required for initiating the movement of the door are matched with the lower more favorable torque requirements presented by the mechanical linkage. The inertial forces produced by the moving door reduce the torque demands at the intermediate angular door positions.

The foregoing mechanical advantage relationships of the linkage assembly 22 may be optimized by transforming the linkage into a mathematical model. The location of the spindle axis R within the housing module is fixed. The position at which the module is mounted to the door frame or header is treated as a variable which defines the location of the spindle axis. The spindle axis R is defined in terms of rectangular coordinates (X1,Y1) of a coordinate system having an origin at the door pivot axis P with the fully closed and opened positions of door 12' defining the X and Y axis. The effective mechanical length of the crank arm (D1) i.e., the distance between the connection with the spindle and the link; the effective mechanical length of the link (D2), i.e., the distance between the pivotal connections with the crank arm and the bracket; and the position of the pivotal connection between the link and th bracket expressed by rectangular coordinates (X2, Y2), which may be established by the location and the length of the bracket, i.e., the distance of the pivotal connection from the face of the door and the pivot axis P of the door, are each treated as variables. The variables of the integrated model of the mechanical system are selected so as to obtain a favorable mechanical advantage requiring lower applied torque in the vicinity of the door fully opened and closed positions.

Exemplary data is set forth in Table I for a door operator system such as illustrated in FIG. 4 wherein the operator spindle axis R is located at position X1=18.373 ins., Y1=3.125 ins. The door bracket connecting axis is located at position X2=13.021 ins-,Y2=7.500 ins. The effective length of the crank arm D1=11.000 ins. The effective length of the link D2=16.937 ins.

TABLE I

| Crank Arm Angle Change (Degrees) | Door Angle Change (Degrees) | Mechanical Advantage |
|---|---|---|
| 0 | 0 | 3.76 |
| 10 | 3.19 | 2.68 |
| 20 | 7.45 | 2.10 |
| 30 | 12.69 | 1.76 |
| 40 | 18.73 | 1.57 |
| 50 | 25.35 | 1.46 |
| 60 | 32.37 | 1.40 |
| 70 | 39.63 | 1.36 |
| 80 | 46.99 | 1.36 |
| 90 | 54.35 | 1.37 |
| 100 | 61.60 | 1.40 |
| 110 | 68.61 | 1.46 |
| 120 | 75.23 | 1.57 |
| 130 | 81.24 | 1.78 |
| 140 | 86.33 | 2.23 |
| 150 | 90.00 | 3.68 |

Data for a second "in" door operates is set forth in Table II wherein the operator spindle axis R is located at position X1=12.887 ins., Y1=−3.125 ins. The door bracket connecting axis is located at position X2=10.660 ins, Y2=−6.125 ins. The effective length of the crank arm is D1=9.000 ins. The effective length of the link D2=11.625 ins.

TABLE II

| Crank Arm Angle Change (Degrees) | Door Angle Change (Degrees) | Mechanical Advantage |
|---|---|---|
| 0 | 0 | 3.74 |
| 10 | 3.16 | 2.73 |
| 20 | 7.33 | 2.14 |
| 30 | 12.49 | 1.78 |
| 40 | 18.47 | 1.58 |
| 50 | 25.08 | 1.46 |
| 60 | 32.10 | 1.39 |
| 70 | 39.37 | 1.36 |
| 80 | 46.76 | 1.35 |
| 90 | 54.15 | 1.36 |
| 100 | 61.43 | 1.39 |
| 110 | 68.48 | 1.45 |
| 120 | 75.14 | 1.56 |
| 130 | 81.20 | 1.77 |
| 140 | 86.33 | 2.22 |
| 150 | 90.00 | 3.27 |

The operation of swing-door operator system 10 in connection with an "out" door opening application is illustrated in FIG. 5. It should be noted that the housing module 20 is mounted, at the interior side of the doorway. The loci of the angular positions of the crank arm/link connection are illustrated by A". The loci of the angular positions of the connection of the link and the door bracket are illustrated by B". The fully opened position of the "out" swing-door 12" is illustrated in phantom.

Table III sets forth data for an application such as illustrated in FIG. 5 wherein the operator spindle axis R is located at coordinates X1=8.4765 ins., Y1=−3.125 ins. The door bracket pivotal connection is located at coordinates X2=9.7589 ins., Y2=1.6875 ins. The crank arm has an effective mechanical length D1=7.250 ins. The link has an effective mechanical length D2=7.4375 ins.

TABLE III

| Crank Arm Angle Change (Degrees) | Door Angle Change (Degrees) | Mechanical Advantage |
|---|---|---|
| 0° | 0 | 3.73 |
| 10° | 3.09 | 2.84 |
| 20° | 7.09 | 2.22 |
| 30° | 12.08 | 1.83 |
| 40° | 17.95 | 1.60 |
| 50° | 24.51 | 1.47 |
| 60° | 31.54 | 1.39 |
| 70° | 38.44 | 1.35 |
| 80° | 46.28 | 1.34 |
| 90° | 53.73 | 1.35 |
| 100° | 61.07 | 1.38 |
| 110° | 68.18 | 1.44 |
| 120° | 74.92 | 1.54 |
| 130° | 81.06 | 1.74 |
| 140° | 86.28 | 2.18 |
| 150° | 90.00 | 3.75 |

Data for a second "out" door operator is set forth in Table IV wherein the operator spindle axis R is located at position X1=14.118 ins., Y1=−11.125 ins. The door bracket pivotal connection is located at position X2=9.7589 ins., Y2=1.6875 ins. The effective length of the crank arm D1=7.25 ins. The effective length of the link DZ=17.2188 ins.

TABLE IV

| Crank Arm Angle Change (Degrees) | Door Angle Change (Degrees) | Mechanical Advantage |
|---|---|---|
| 0 | 0 | 3.69 |
| 10 | 3.33 | 2.55 |
| 20 | 7.81 | 2.00 |
| 30 | 13.25 | 1.71 |
| 40 | 19.43 | 1.54 |
| 50 | 26.14 | 1.45 |
| 60 | 33.19 | 1.39 |
| 70 | 40.45 | 1.37 |
| 80 | 47.79 | 1.36 |
| 90 | 55.10 | 1.38 |
| 100 | 62.28 | 1.41 |
| 110 | 69.20 | 1.48 |
| 120 | 75.70 | 1.61 |
| 130 | 81.57 | 1.83 |
| 140 | 86.48 | 2.32 |
| 150 | 90.00 | 3.82 |

In a preferred form, the linkage assembly 22 is configured so that the resulting mechanical advantage is a ratio at least greater than 2.00 and preferably greater than 3.00 at the fully opened and fully closed positions of the swing-door. The operator spindle 60 preferably angularly rotates through an angle of rotation ranging from approximately 130° to 160° (150° for the embodiments of Tables I—IV) to effect a 90 pivotal movement of the associated swing-door.

Figure 6:
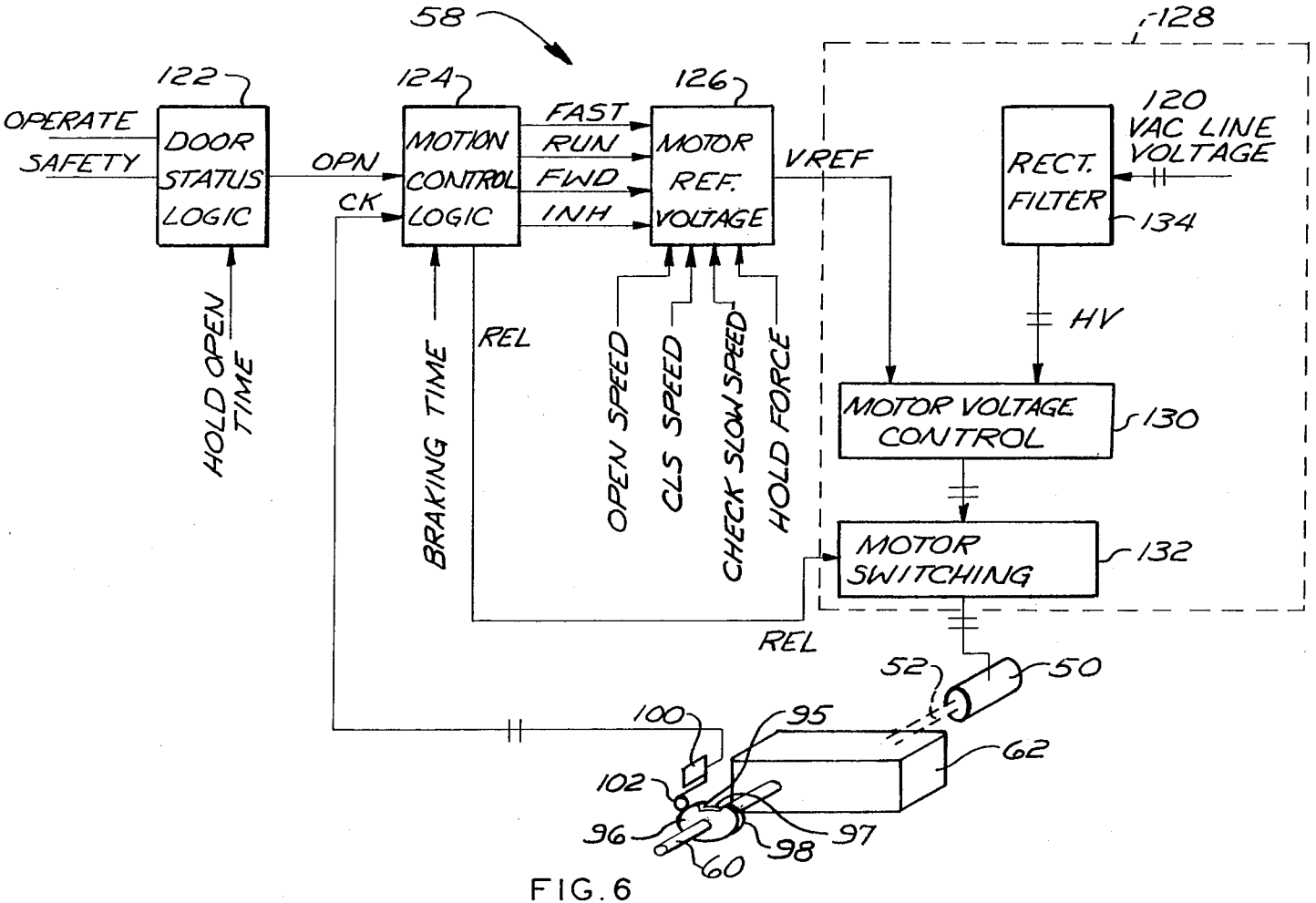
FIG. 6 is a functional block diagram illustrating the operation of the swing-door operator system of FIG. 1.

With reference to FIG. 6, the operator system 10 functions to drive the door 12 in both the opened and closed directions. The door is also held opened and held closed by the motor 50 at a very low power on the order of approximately 15 watts. The electronic controller unit 58 receives door status signals and the line voltage power supply and functions to provide the desired control for the electric motor 50. The electric motor 50 is a multi-speed, fractional horsepower DC motor which is also bi-directional. The control unit 58 provides means for adjustably pre-setting the opening speed, the closing speed, a check speed, a hold force threshold and a braking interval during which time the movement of the door is braked. The speeds are implemented by applying a selected voltage to the motor. The braking is accomplished by reversing the voltage polarity to the motor at the end of the door travel.

Ordinarily, the associated swing-door is power opened by the operator at an opening speed until the door enters an opening check zone just prior to approaching the fully opened position. Upon entering the check zone, the motor operates to brake the movement of the door for a pre-established brake time interval and to subsequently open the door at a reduced check speed until the door reaches the fully opened position. At the fully opened position, the door is powered in a stall condition until either an actuation command has been removed or for a pre-established delay time interval. The door is then power closed at a closing speed until the door enters a closing check zone just prior to approaching the fully closed position. Upon entering the closing check zone, the motor operates to brake the movement of the door for a pre-established braking time interval by means of reversing the voltage leads to the motor until the door reaches the fully closed position. The motor is maintained in an energized stall condition until a new actuation signal is transmitted to the control unit from the doorway. The stall condition of the motor establishes a holding force to maintain the door in the closed or opened position.

The electronic control unit 58 receives input signals and functions to control the DC motor 50 to operate a swing-door as outlined above. DC motor 50 mechanically couples with the operator spindle 60 via the transmission assembly 62 or 262 for controlling the operation of the associated swing-door through the linkage assembly 22.

The electronic control unit includes a door status logic circuit 122. The door status logic circuit 122 receives anOPERATE input signal and a SAFETY input signal from the general location of the door. The SAFETY signal may be generated by a safety mat. The OPERATE and SAFETY signals function as the door actuation signal for initiating the door opening sequence. A hold open time adjustment for selecting the time interval during which the door remains open may also be pre-set into the logic circuit 122. The door status logic circuit generates an opening OPN signal.

The door status logic circuit 122 contains the timing circuitry which upon reception of the OPERATE signal from a sensor of any of numerous conventional forms generates the OPN signal for initiating the door opening, maintaining the opening sequence and holding the door open for the pre-selected time. The OPN signal then changes to a low state to allow the door to close. When safety carpets or other similar safety sensors are employed, the OPERATE signal will not open the door if the SAFETY signal is also present. Once a door is opened, the presence of a SAFETY signal will hold the door open indefinitely until the signal is removed or changes to a low state.

The check control micro-switch 100 generates a feedback CK signal to the control unit at a pre-established angular position of the operator spindle (and hence door 12) for initiating a braking sequence and transforming the speed of the door to a reduced check speed.

The OPN signal and the CK signal form inputs to a motion control logic circuit 124. The motion control logic circuit 124 also has means for pre-setting the braking time interval adjustment. The motion control logic circuit 124 generates a digital REL signal for defining polarity of connection, and therefore the direction of rotation of the electric motor. The logic circuit also generates digital FAST, RUN, FWD, and INH signals to a motor voltage reference switching circuit 126 for defining the speed mode of the electric motor.

The motor voltage reference switching circuit 126 has means for pre-setting the opening speed, the closing speed, the check speed and the door holding force threshold. The voltage reference switching circuit 126 generates a VREF signal which provides an analog reference voltage signal to the motor control circuit 128.

The motor control circuit 128 comprises an electronic motor voltage control circuit 130 responsive to the VREF signal for applying a voltage to the motor 50 and an electromechanical relay switching circuit 132 which is responsive to the REL signal for selectively switching the polarity of the voltage applied to the motor.

Figure 9:
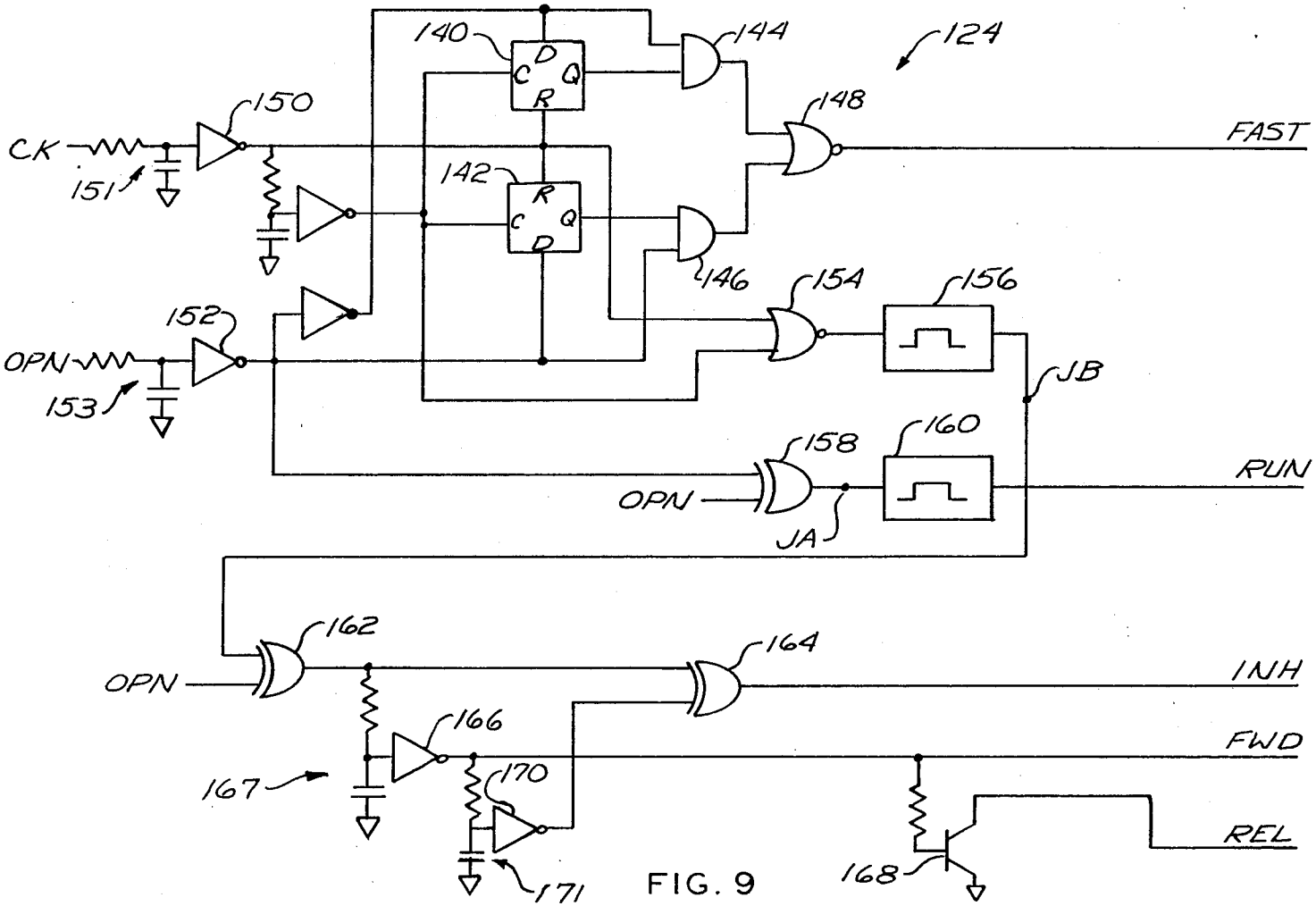
FIG. 9 is a schematic diagram of a motion control logic circuit of the block diagram of FIG. 6.

The motor 50 preferably operates on a 120 volt line voltage which is rectified and filtered in circuit 134. A filtered HV voltage signal is transmitted to the motor voltage control circuit 130. The motor voltage control circuit 130 generates the appropriate voltage for operating the DC motor 50. The motor switching circuit 132 functions to connect the electric leads to the motor in the proper polarity. With additional reference to FIGS. 9 and 12, the motion control logic circuit 124 performs the sequential logic for generating a set of four digital signals which governs the motor voltage control circuit to thereby provide the desired motor speed. The motion control logic circuit 124 is responsive to the status of the OPN and CK signals and generates digital signals in accordance with the logic table of Table V.

TABLE V

| | |
|---|---|
| INH: | 0 for motor on |
| | 1 for motor off |
| RUN: | 0 for motor stalled |
| | 1 for motor running |
| FWD: | 0 for reverse drive or closing |
| | 1 for forward drive or opening |
| FAST: | 0 for slow speed (check) |
| | 1 for fast speed (open or close) |

The CK signal is generated by the cam actuated micro-switch 100. When a positive CK transition occurs, the states of flip-flop 140 and flip-flop 142 change in accordance with the state of the OPN signal which is applied to flip-flop data inputs D. The output of flip-flop 140 is applied to AND gate 144, and the output of flip-flop 142 is applied to AND gate 146. The output of AND gates 144 and 146 is applied to NOR gate 148 which changes the state of the FAST signal to a low state and the reference switching circuit thereby applies a slow speed i.e., low voltage reference VREF signal to the motor control circuit.

When the OPN signal changes states, the FAST signal is restored to a high state via AND gates 144 and 146 for reversing directions. Each positive transition of the CK signal is applied via Schmitt trigger inverters 150 and 152 and their associated resistance/capacitance circuits 151 and 153, respectfully, to NOR gate 154 which generates a starting pulse for brake timer 156. The transitions of the OPN signals are detected by the XOR (exclusive - OR) gate 158 which generates a starting pulse at junction JA. The starting pulse starts the RUN timer 160 thereby placing the motor operation at a fast speed for up to five seconds. The five second interval of operation is implemented after each transition from either the door opened to closing (high OPN to low OPN) state, or the door closed to opening state. At the end of the five second cycle, the motor 50 is switched to a stall/hold mode via the reference switching circuit. The associated swing-door is thereby allowed approximately five seconds for traversal from the fully closed to the fully opened position. Any interference in the door opening will result in a low power stall operation to thereby protect the motor and solid state power components.

Figure 12:
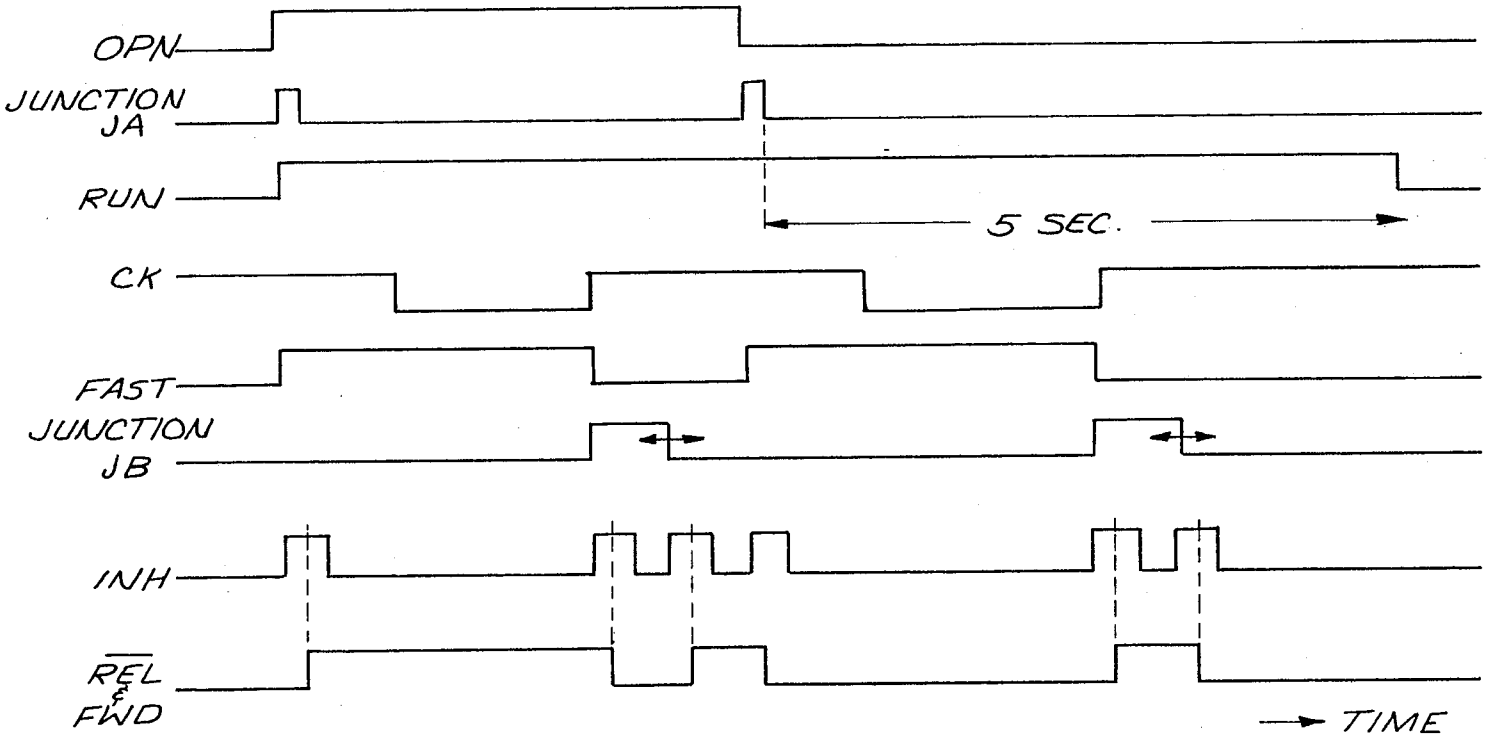
FIG. 12 is a graphical illustration of various signal waveforms and their relationship for the motion control logic circuit of FIG. 9.

The output of the brake timer 156 as illustrated at junction JB initiates a braking cycle by setting the INH signal high and reversing the relay REL signal and the direction of the FWD signal. The output of brake timer 156 and the OPN signals are applied to XOR gate 162. The output of XOR gate 162 is applied to XOR gate 164 for generating the INH signal. The output of XOR gate 162 is also applied to Schmitt trigger inverter 166 and an associated resistance/capacitance circuit 167 for generating the direction FWD signal and the REL signal via transistor 168. The output from inverter 166 is applied to Schmitt trigger inverter 170 and an associated resistance capacitance circuit 171. The output from inverter 170 is applied to XOR gate 164. The Schmitt trigger inverters 166 and 170 and respective associated resistance/capacitance circuits 167 and 171 insure that the relay switching occurs while the INH signal is in a high state and the motor is de-energized as illustrated in FIG. 12. The circuits are pre-adjusted so that sufficient time delay is provided to allow any transient currents present in the motor and motor drive circuits to decay to negligible values at the moment the relay switching terminates. The latter mode of operation prevents the voltage arcing at the relay contacts of electromechanical relay circuit 132 to thereby insure a long relay life.

Figure 8:
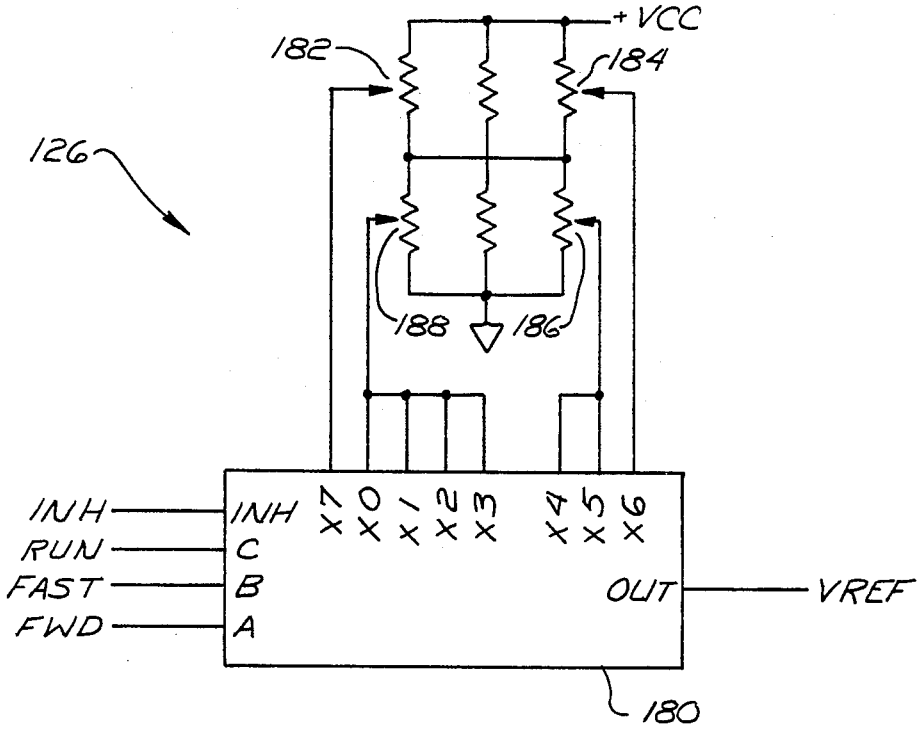
FIG. 8 is a schematic diagram of a reference switching circuit of the block diagram of FIG. 6.

With reference to FIG. 8, the voltage reference switching circuit 126 employs an eight channel analog multiplexer 180 which selectively switches to the output of pre-set reference voltages. Potentiometers are preferably employed for setting the reference voltages. Potentiometer 182 is employed for setting the opening speed adjustment. Potentiometer 184 is employed for setting the closing speed. Potentiometer 186 is employed for setting the check speed. Potentiometer 188 is employed for setting the stall/hold voltage. The internal decoder of the multiplexer switches the output voltage VREF in accordance with the status of the RUN, FAST, FWD, and INH signals. A high INH signal results in the output VREF signal being set to 0 regardless of the status of the other signals. The output analog VREF signal is generated in accordance with the truth table set forth in Table VI.

TABLE VI

| Reference Generated | LOGIC STATES INH | RUN | FWD | FAST | |
|---|---|---|---|---|---|
| Open Speed | 0 | 1 | 1 | 1 | |
| Close Speed | 0 | 1 | 0 | 1 | Signal States: |
| Check Speed | 0 | 1 | X | 0 | 1 - High |
| Stall/Hold | 0 | 0 | X | X | 0 - Low |
| OFF | 1 | X | X | X | X - Does Not Matter |

Figure 7:
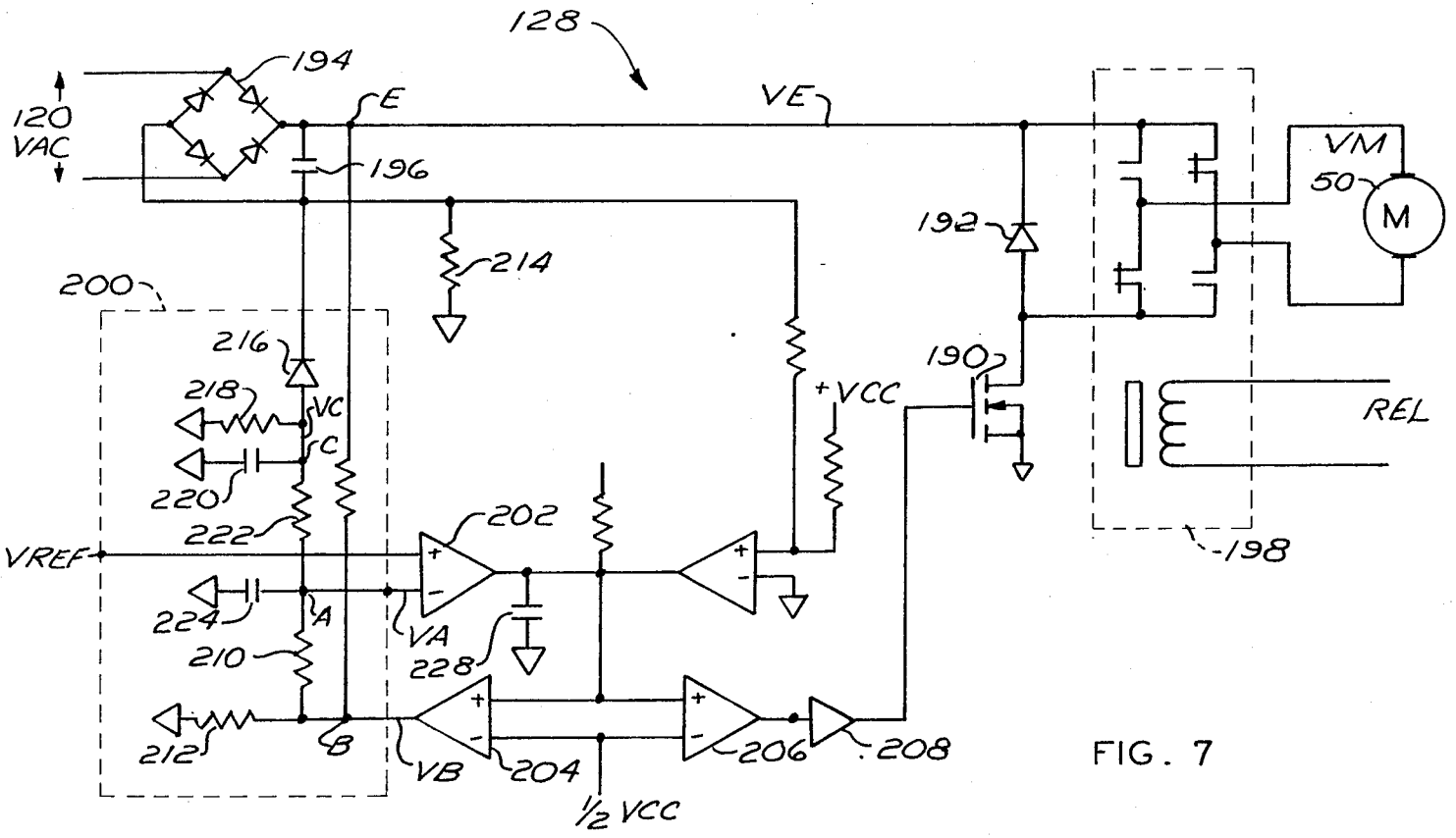
FIG. 7 a schematic diagram of a motor control circuit of the block diagram of FIG. 6.
Figure 10:
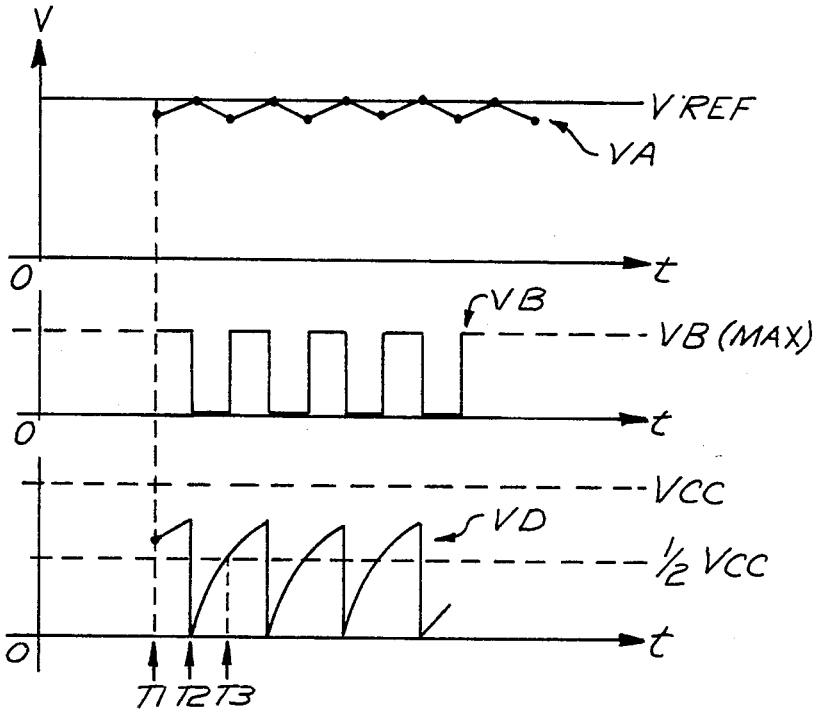
FIG. 10 a graphical illustration of pulse width modulator control waveshapes for the motor control circuit of FIG. 7.

With reference to FIG. 7 and FIG. 10, the digital VREF signal and the digital REL signal are applied to the motor control circuit 128 which applies power to the motor 50. The voltage on the motor 50 is controlled by a power field-effect transistor 190 working in conjunction with a free wheeling diode 192. The power field effect transistor operates in switching mode and is controlled by a pulse width modulator. The DC power supply for the motor 50 is derived by rectifying 120 volt line voltage by means of a bridge rectifier 194 and a filter capacitor 196 to form voltage VE.

An electromechanical relay 198 is employed for reversing the direction of rotation of the motor and for braking the motor by switching the motor lead connections to the drive circuit. The electronic circuitry of the motion controlled logic circuit 124 coordinates the timing of the relay switching via REL signal and the reference voltage VREF signal so that no large DC currents can be interrupted by the relay contacts.

A feedback circuit 200 is employed to model the operation of the motor so as to compensate for motor loads, line voltage variations and line rectifier output ripple. Two comparators 202 and 204 having open collector outputs are connected as a PWM control circuit to generate the required gate drive waveshape. The drive waveshape is transmitted to the power transistor 190 via a comparator 206 and a pulse amplifier 208.

The principal waveshapes within the pulse width modulator circuit are illustrated in FIG. 10. The amplitude of voltage VB is proportional to the rectified line voltage VE as sensed through the divider made with the resistors 210 and 212. Comparators 206 and 204 have inputs in parallel. Voltage VA results from the integration of the pulses at the comparator 204 output VB. The reference voltage VREF is compared to voltage VA at comparator 202. Comparator 206 ultimately controls the motor 50 by driving the power transistor 190 so that the pulses at the output of comparator 204 represent a scaled image of the voltage which drives the motor 50. The integral of the voltage VB represents the motor CEMF if the effect of the load current is taken into account. The motor CEMF is proportional to the motor speed.

When the transistor 190 is conducting, the full line rectified voltage VE is applied to the motor. The current in the motor increases in an exponential linear mathematical relationship wherein the slope is primarily limited by the inductance of the motor armature. When the transistor 190 is turned off, the armature inductance keeps the current flowing through the free wheeling diode 192. Because the motor voltage switching takes place at approximately 20 khz and the motor time constant i.e., the ratio of armature inductance to armature resistance, is much greater than the switching times, the motor current is essentially a DC current having a small ripple component.

The amplitude of the current pulse in the transistor 190 as sensed by the current sense resistor 214 approximately represents the average motor current I. The circuit comprising diode 216, resistor 218 and capacitor 220 functions as a peak detector which memorizes the amplitude of the pulsed current seen in the sense resistor 214. The voltage which is proportional to the motor current is applied across proportioning resistor 222 and is subtracted from the voltage VB representing the motor voltage at junction A. Integrating capacitor 224 also connects at junction A. The pulse voltage VB is integrated by charging or discharging integrating capacitor 224 via the integrating resistor 210.

The voltage at the junction A is represented by the equation:

$$VA = VB - K*VC$$

Where K is a constant established by the resistance of proportioning resistor 222.

Since the pulse width modulated circuit operates to equalize the voltage VA with the voltage VREF, the result will be that the VREF voltage will approximately dictate the motor voltage V and the motor speed which is proportional to the CEMF as defined by the following relationship:

$$V = E - IR$$

Where:

E=motor CEMF (proportional to VA);

V =motor voltage (proportional to VB);

IR =current induced voltage drop (proportional to VC), with I being the motor current and R being the motor armature resistance.

Consequently, the feedback circuit 200 represents a model of the motor wherein the values of the motor voltage and current are determined without requiring a direct in circuit measurement.

The operation of the pulse width modulated (PWM) control circuit 128 is illustrated by the waveshapes in FIG. 10. An initial state is shown at the moment time T1. The integrating capacitor 224 charges from the voltage VB via the resistor 210. At time T2 the voltage VB equals or exceeds the VREF lead voltage. The comparator 202 discharges the capacitor 228 which reduces the output of comparator 204 to zero. The capacitor 224 discharges and voltage VA decreases. The output of comparator 202 is in an off state, thereby allowing the capacitor 228 to charge from the power supply VCC via resistor 230. The voltage VA will decrease until the moment the voltage VD on the capacitor 228 exceeds the ½ VCC voltage level at the time T3, wherein the output of comparator 204 becomes high again and a new PWM cycle is initiated. By selecting the values of the capacitors 228 and 224 and resistors 230 and 210, the ripple on the voltage VA is made small in comparison to voltage VA so that voltage VA will closely follow voltage VREF. Because voltage VA represents the time integral of the pulses VB, the motor voltage VM will also follow the voltage VREF as set forth in the following relationship:

$$VM = K*VREF = VE*d$$

Where:

VM is the motor voltage;

K is a constant;

d is the pulse width modulated duty ratio ($0<d<1$); and

VE is the rectified line voltage.

An advantage of the foregoing mode of operation is that while the rectified line voltage VE exhibits a relatively large ripple content in the event of selection of a small filter capacitor 196, the motor average voltage VM will nevertheless be substantially constant when the voltage VREF is constant. The circuit feedback will vary the duty factor d to compensate for relatively slow 120 Hz rectified line voltage VE ripple. Since the motor is operated at lower speeds than rated, i.e., will require less voltage for operation, a much smaller filter capacitor 196 can be employed and the large resulting voltage ripple will not be sensed by the motor 50.

It will be appreciated that the time the motor 50 is driven in reverse, e.g. the pre-set brake time interval, is adjustable to match the inertia of the associated swing-door. The braking torque which is developed by the motor is proportional to the motor current I. The motor current is limited and controlled by the pulse width modulated control circuit 128. The described method of braking is able to produce substantially larger torques than that of conventional dynamic braking which is relatively ineffective at the low motor speeds at which the motor 50 operates in the operator system.

The process of direction reversal from the closing to the opening or the opening to the closing directions is very similar to the braking process except that a sufficient time is allowed for the motor to slow down, stop and re-accelerate in a reverse direction. The direction reversal is accomplished in a similar manner to that described for braking with the OPN signal acting directly on the input of XOR gate 158.

It will be appreciated that the foregoing electronic motor control unit 128 allows for motor operation at reduced motor speeds while developing adequate acceleration torque to operate a mechanical transmission with a low gear ratio. The electronic controlled braking, by means of momentary motor reversal, develops relatively high braking torques at any motor speed. The motor modeling feedback circuit 200 eliminates the need for a direct sensing of the motor voltage and current and efficiently compensates for motor loads, line voltage variations and line rectifier output ripple. The motor functions as an electric spring to hold the door closed or opened with an adjustable force threshold determined by the stall motor speed.

The door operator system may be manually operated by manually moving the swing-door in which case the linkage assembly 22 acts via the spindle 60 and the transmission assembly 62 or 262 against the motor. In addition, a safety break out mechanism may be activated in case of power failure. The safety mechanism (not illustrated) may comprise a spring biased mechanism at the door bracket which breaks away upon the exertion of a pre-established pivotal force applied to the door.

It should be appreciated that the foregoing operator system 10 is highly compact and is highly efficient. A single electric motor and transmission assembly is employed for both the opening and closing functions. In addition, maintenance problems are greatly reduced since the mechanical transmission does not require lubrication nor does it require re-tensioning or readjustment of the timing belts and shafts. The operator system is not right-handed or left-handed as such since the motor is bi-directionally driven. Consequently, a single unit may be employed universally.

While a preferred embodiment of the foregoing invention has been set forth for purposes of illustration, the foregoing description should not be deemed a limitation of the invention herein. Accordingly, various modifications, adaptations and alternatives may occur to one skilled in the art without departing from the spirit and the scope of the present invention.

What is claimed:

1. A door operator system for controlling the operation of a pivotally moveable door comprising:

motor means including a drive shaft for selectively bi-directionally rotatably driving said drive shaft;

control means responsive to a plurality of input signals for selecting a voltage value from an array of pre-established voltages and deriving a motor voltage from said selected voltage value and generating a desired voltage polarity signal, said control means comprising means for applying said polarity signal and said selected voltage value to energize said motor means for driving said drive shaft at a selected speed and direction;

transmission means including an operator shaft for translating rotatable motion of said drive shaft to a corresponding reduced speed rotatable motion of said operator shaft; and linkage means connecting said operator shaft in generally fixed angular relationship therewith and comprising connector means for pivotally connecting with an associated door, said operator shaft angularly driving said linkage means for pivotally opening and closing the door in accordance with the operation of said motor means.

2. The operator system of claim 1 further comprising a housing, said motor means and transmission means being mounted in said housing with a portion of said operator shaft projecting through said housing.

3. The operator system of claim 1 wherein the ratio of the speed of the motor drive shaft to the speed of the operator shaft is in the range of 30–100.

4. The operator system of claim 1 further comprising stop means for preventing the operator shaft from angularly rotating beyond a pre-established angular position.

5. The operator system of claim 1 wherein when the associated door is pivoted approximately 90°, the operator shaft is rotated an angular distance in the range of 120° to 180°.

6. The operator system of claim 1 further comprising sensor means for sensing the presence of a door opening or door closing event and transmitting an appropriate electrical input signal to the motor control means for selective operation thereof.

7. The operator system of claim 1 wherein said transmission means further comprises two idler shafts, said drive shaft, idler shafts, and operator shafts being generally parallel, one said idler shaft having a driven and a driver pulley mounted in fixed angular relationship therewith and a second said idler shaft having a driven pulley mounted in fixed angular relationship therewith, a belt driveably connecting said drive shaft and the driven pulley of one idler shaft, and a second belt driveably connecting the driver pulley of said one idler shaft and the driven pulley of said second idler shaft.

8. The operator system of claim 7 wherein each said belt has a generally constant width, the width of said first belt being less than the width of said second belt.

9. The operator system of claim 7 wherein the pulleys have teeth and the belts are positively rotatably keyed to said teeth.

10. The operator system of claim 7 wherein the pulleys are molded from a plastic material.

11. The operator system of claim 7 further comprising a third belt and an operator driven pulley keyed to said operator shaft and driven by said third belt.

12. The operator system of claim 1 further comprising a timing cam mounted in angularly fixed relationship with said operator shaft, and a switch means responsive to the angular position of said timing cam for transmitting an input signal to said control means, said input signal being indicative of a pre-established angular position of said operator shaft.

13. The operator system of claim 12 wherein said timing cam comprises an angularly adjustable plate and said switch means is responsive to pre-selected angular positions defined by said plate for transmitting signals indicative of attained opening and closing door positions.

14. The operator system of claim 1 wherein said linkage means comprises a crank arm having first and second ends, said first end connected in fixed angular relationship to said operator shaft and a link pivotally connected relative to said second crank arm end.

15. The operator system of claim 14 further comprising a bracket having a pivot connector adapted for mounting in fixed relationship to an associated door so as to project outwardly therefrom and having a pivot connector, said link pivotally connecting said connector.

16. The operator system of claim 15 wherein the associated door is pivoted approximately 90° between the fully opened and closed position and the linkage means is configured so that at the fully closed and opened positions the mechanical advantage of the linkage means is greater than 2.

17. A swing-door operator comprising:

electric motor means including a drive shaft for rotatably bi-directionally driving said shaft at a plurality of speeds;

transmission means comprising an operator shaft for transferring rotatable drive motion of said drive shaft to a reduced bi-direction rotatable motion of said operator shaft;

feedback means responsive to a pre-established angular position of said operator shaft for generating a CK signal;

door status input means for generating a door status OPN signal;

electronic motor control means responsive to said CK and OPN signals for selecting a reference voltage from an array of pre-established voltages and deriving a motor voltage and applying said derived voltage to said motor means for controlling the speed thereof and for generating a direction control signal and applying said direction control signal to said motor means for controlling the direction thereof;

so that said drive shaft may be sequentially operated in dual speed forward and reverse directions in accordance with the CK and the OPN signals for rotating and braking said operator shaft.

18. The operator of claim 17 further comprising presetting means for adjustably pre-setting said array of voltages.

19. The operator of claim 17 wherein said control means further comprises model circuit means for sensing the current applied to said motor means.

20. The operator of claim 17 wherein said motor means has electrical leads for external electrical communication and said control means further comprises an electromechanical relay responsive to the selected direction control signal for reversing the electrical leads to said motor means.

21. The operator of claim 17 wherein one said pre-established voltage corresponds to an opening speed of said operator shaft, a second pre-established voltage corresponds to a closing speed of said operator shaft, and a third pre-established voltage corresponds to a reduced check speed of said operator shaft.

22. The operator of claim 21 further oomprising a fourth pre-established voltage which corresponds to a stall torque of said operator shaft.

23. The operator system of claim 17 wherein said control means further comprises braking circuit means for effecting a braking torque to said motor drive shaft by reversing the voltage polarity to said motor means for a pre-established time interval when said CK signal changes from a low to a high state.

24. The operator system of claim 23 wherein said control means further comprises check speed means for applying a reduced reference voltage to said motor means subsequent to the elapse of said time interval.

25. An electronic operator for a swing-door comprising:

a direct current motor comprising a drive shaft and electrical leads for applying a motor voltage to said motor for rotating said drive shaft at a speed corresponding to said applied voltage;

a transmission including an operator shaft for translating the rotational motion of said drive shaft to reduced speed motion of said operator shaft;

feedback signal means for generating a CK signal indicative of a given angular position of said operator shaft;

door status means for generating an OPN signal indicative of a door status condition;

electromechanical relay means for changing the polarity of the voltage applied to said leads;

electronic control means comprising means for pre-setting first, second, and third reference voltages and logic means responsive to said CK and OPN signals for selecting a reference voltage and generating a REL direction signal, said electronic control means comprising means for applying said REL signal to said relay means and employing said selected reference signal to generate a motor voltage for application to said electrical leads so that said operator shaft may be sequentially driven in dual speed forward and reverse directions and a reverse torque applied to said operator shaft for a pre-established time interval to brake the speed of said operator shaft.

26. The electronic operator of claim 25 wherein said electronic control means further comprises model circuit means remote from said motor for generating voltage and current signals which correspondingly approximate the values of the motor voltage and

27. The electronic operator of claim 25 wherein said electronic control means further comprises stall means for deriving and applying a stall voltage to said motor leads for maintaining a preset force on the door when fully open or closed.

28. The electronic operator of claim 27 wherein said electronic control means further comprises means for pre-setting a fourth reference voltage, said stall voltage being derived from said fourth voltage.

* * * * *

UNITED STATES PATENT AND TRADEMARK OFFICE

CERTIFICATE OF CORRECTION

PATENT NO. : 4,727,679

DATED : March 1, 1988

INVENTOR(S) : Henning N. Kornbrekke et al

It is certified that error appears in the above-identified patent and that said Letters Patent is hereby corrected as shown below:

Claim 22, line 1, substitute -- comprising -- for "oomprising".

Claim 26, line 5, insert -- current. -- after "and".

Signed and Sealed this

Twenty-fifth Day of October, 1988

*Attest:*

*Attesting Officer*

DONALD J. QUIGG

*Commissioner of Patents and Trademarks*